United States Patent [19]

Properzi

[11] 4,008,753

[45] Feb. 22, 1977

[54] CONTINUOUS CASTING MACHINE OF THE WHEEL AND BAND TYPE

[76] Inventor: Giulio Properzi, Via Pietro Cossa, 1, Milan, Italy, 20122

[22] Filed: Oct. 21, 1974

[21] Appl. No.: 516,839

[30] Foreign Application Priority Data

Oct. 22, 1973 Italy ..... 30388/73
July 4, 1974 Italy ..... 24812/74

[52] U.S. Cl. ..... 164/278; 164/280; 164/283 MS

[51] Int. Cl.[2] ..... B22D 11/06

[58] Field of Search .... 164/276, 278, 282, 283 MS, 164/280, 8 L

[56] References Cited

UNITED STATES PATENTS

| | | | |
|---|---|---|---|
| 3,284,859 | 11/1966 | Conlon et al. | 164/276 X |
| 3,529,658 | 9/1970 | Properzi | 164/278 |
| 3,628,597 | 12/1971 | Properzi et al. | 164/278 X |

*Primary Examiner*—Francis S. Husar
*Assistant Examiner*—Gus T. Hampilos
*Attorney, Agent, or Firm*—Guido Modiano; Albert Josif

[57] ABSTRACT

A continuous casting machine comprising a wheel with a peripheral casting ring covered through a certain arc by a band.

The wheel and ring are mounted on a supporting structure principally comprising two facing flanges fixed to a driveshaft for the wheel, for rotation therewith. The casting ring comprises peripheral edges parallel to the axis of the casting wheel and resting on peripheral surface of the flanges.

The peripheral edges of the casting ring have a certain slack on the peripheral surfaces of the flanges, whereby the ring has the freedom to translate in a direction substantially parallel to the axis of the wheel. On the other hand the casting ring is constrained to be dragged in the direction of rotation of the casting wheel by a plurality of keys disposed along the periphery thereof and of the flanges.

9 Claims, 4 Drawing Figures

28
5
5a
3
5b
5a
28
5

2
13
15
11
14
13
2
9
5
3
4
7
6
10
8
5
1
16
17

CONTINUOUS CASTING MACHINE OF THE WHEEL AND BAND TYPE

BACKGROUND OF THE INVENTION

This invention relates to a continuous casting machine of the type comprising a wheel with a peripheral casting ring and a band covering the ring through a certain arc, the casting ring being supported by a structure which supports the wheel.

In a machine of this type for continuously casting a metal bar of indefinite length, the metal casting ring comprises along its outer perimetral surface a channel covered by the metal band to form a reception throat for the metal, and is supported by a support and centering structure which transmits the drive torque to the ring. The machine is also provided with a suitable cooling system for the inner surface of the casting ring and outer surface of the band. The molten metal, which is poured into the channel and retained by the metal band which adheres to the ring, is cooled while the wheel rotates through a distance equal to the arc covered by the band, and is extracted solidified from the channel before the wheel has made a complete turn.

There are numerous problems encountered in improving the utilisation of a continuous casting machine of the type described.

Among these are problems of thermal origin, i.e. fatigue phenomena of the material forming the ring due to internal stresses induced by the inevitable frequent temperature changes.

In this respect it is clear that any hypothetical section of the casting ring during its rotational movement undergoes a continuous cyclic change in the thermal stresses, due to the fact that the temperature difference between the inner and outer surfaces of said section is a maximum at the moment of reception of the molten metal, and then progressively decreases during cooling and solidification of the metal until it reaches a minimum after completing one turn, before again receiving molten metal.

These thermal stresses are inevitable because they are brought about by the cooling of the metal and the rotation of the ring, and to them are added further stresses of thermal origin induced into the material by temperature differences existing on the inner cooled surface of the ring, these differences being caused by non-uniform cooling of the ring, i.e. by bad distribution of the cooling fluid.

These two main types of stress of thermal origin give rise to the rapid aging of the ring material, decreasing its useful life and therefore making frequent replacement of the ring necessary with consequent considerable slowing down of production and wastage of material and labour.

In seeking more uniform cooling of the ring and therefore a more uniform distribution of cooling fluid, the cooling device which has been most accepted and which has given the best service is that comprising cooling by means of sprays. This device consists of a non-rotating annular header internal and concentric to the casting ring, suitably supplied with cold fluid and comprising on the surface facing the ring a series of spray nozzles arranged to feed jets of fluid on to the surface to be cooled. The header is arranged stationary since a differentiated cooling action is desired for the various sections of the groove arc actually contacting the molten metal.

Generally however, even a device constructed in this manner is not able to provide a rigorously uniform distribution of cooling fluid on the ring surface, as would be required to prevent the formation of poorly or variously cooled zones which would give rise to internal stresses due to surface temperature differences. This occurs either because the jets of cooling fluid are intercepted by parts of the rotating structure which supports the casting ring or because they strike the ring at points relatively distant from each other. The first case occurs in practice in most types of construction and is due to the fact that the system used for anchoring the ring comprises cross members disposed parallel to the axis of rotation of the ring for connecting together the two centering flanges which support the ring, so that only one of said flanges needs be connected to the drive shaft. This arrangement, advantageous from the point of view of simplicity of assembly and replacement of the casting ring, gives rise to considerable disadvantages with regard to heat removal. In this respect, said support cross members, which can only be located in the space between the spray nozzles and the hot surface of the ring, interfere with the cooling jets during rotation of the casting wheel, giving rise to constantly undercooled zones and thus to adjacent zones of different temperatures, which because of different degrees of expansion cause internal stresses which because of their cyclic character lead to rapid aging of the material. Constructional reasons determine the fact that the jets strike the ring at points relatively distant from each other because there is a limit to the distance at which the spray nozzles, disposed on a header of diameter less than the ring, can be spaced apart. It is evident that in this case there are areas of the ring which are cooled to a greater extent because they are struck directly by the jet of cold fluid, alternating with lesser cooled areas which are not struck directly but are lapped by the heated fluid leaving the ring surface. Again, because of the presence of the cross members, the spray nozzles have to be disposed at a large distance from the ring and this leads to a still greater distance between the jets striking the ring, consequently worsening the uniformity of cooling.

The non-uniform cooling action described above, besides slowing considerably the production rate because of the frequent ring replacement requirements, affects adversely the quality of the resultant product, which may exhibit lack of structural uniformity and accordingly inferior mechanical and electrical properties.

The connection of the flanges by the use of cross members is further disadvantageous in that the drive torque for the ring is transferred through a single flange, which becomes subjected to higher stress conditions. When it is considered that the flange is also subjected to generally cyclic stresses of thermal origin at the very areas of attachment of the interconnecting cross members, it will become apparent how the constructional solution described above is in many ways unsatisfactory.

On the other hand, if the cross members were simply removed, the other flange, mounted idly to the stationary part of the machine, would be forced to rotate by the casting ring itself. An arrangement of this type involves the disadvantage of stressing the ring mechanically, which is also subjected to the highest thermal stresses developed in these machines. Accordingly, the operating conditions are made heavier still for the ring and further aggravated by the marked asymmetry of the above cited mechanical stresses, which may lead to unacceptably high distortion of the ring.

With regard to the internal stresses induced by the temperature gradient between the inner and outer surfaces of the casting ring, these stresses cannot be eliminated because they are caused by the necessary cooling of the metal and the rotation of the ring together with the casting wheel. Because of the impossibility of eliminating these internal stresses, it has been considered impossible up to the present time to find an efficient solution to the problem of ring life with respect to these stresses, and the method so far used has rather been one of using for the ring more appropriate materials or more suitable forms for supporting these stresses, compatible with the casting requirements, but this has not led to appreciable results with regard to the life of the ring, which always has to be frequently replaced.

SUMMARY OF THE INVENTION

It is an object of the present invention to provide a continuous wheel casting machine of the peripheral ring type which considerably limits the internal stresses of thermal origin in the casting ring, so considerably increasing the life of the material forming the casting ring and thus substantially reducing the frequency with which the ring has to be replaced, leading to evident advantages in cost and productivity of the continuous casting machine.

Another object of the invention is to provide such a continuous casting machine, wherein the torque to be transmitted to the casting ring can be equally distributed to the wheel flanges, thus preventing any relative stresses in the casting ring and simultaneously increasing the life duration of the whole wheel assembly, and wherein, through the elimination of any interference between the cooling fluid and ring portions, it becomes possible to remove the above-mentioned lack of uniformity of the cooling action, thereby improving the quality of the resultant product.

These objects are attained according to the invention by a continuous casting machine of the previously specified type, in which the supporting structure for the casting wheel consists substantially of two facing flanges affixed to a drive shaft for said wheel, for rotation therewith, and the casting ring comprises peripheral edges projecting substantially parallel to the axis of said casting wheel and resting on outer peripheral surfaces of said flanges with the freedom to translate in a direction substantially parallel to the axis of said wheel and perpendicular thereto and constrained to be dragged in the direction of rotation of said casting wheel.

A structure of this type enables the negative effects of internal stresses of thermal origin to be limited with regard to the material life, because while it is not possible to eliminate these stresses, it enables the internal stresses to be transformed into free but controlled deformation, the term controlled deformation meaning a deformation which takes place in a determined direction, by providing the ring with one degree of freedom in this direction, i.e. eliminating the lateral constraint but preserving the constraint in the direction of transmission of the drive torque. This free deformation prevents the internal stresses exceeding a certain limit, as said stresses are counterbalanced on the outside only by friction forces, contrary to what takes place in a ring without degrees of freedom, where because of the natural elasticity of the constraints, deformations take place which are smaller than the free deformations but the internal stresses are so high that in certain cases they exceed the elastic limit, i.e. permanent deformations are generated after a certain number of cycles. The new arrangement also permits the casting ring to expand in the radial direction, which facilitates the axial sliding of the peripheral projecting edges of the ring on the cylindrical flange surfaces, since the radial expansion causes separation of the ring surfaces from the flange surfaces.

According to an advantageous embodiment of the invention, the peripheral casting ring has a cross section substantially of Ω shape, the branches of this Ω forming said peripheral projecting edges, and the facing flanges define two substantially cylindrical peripheral centering surfaces bounded laterally towards the outside by two shoulders, the peripheral ring being disposed with the branches of the Ω on the cylindrical centering surfaces with a certain clearance with respect to the shoulders.

In the case of a cross section substantially of Ω shape, the deformation caused by the internal stresses of thermal origin consists of an increase in the radius of curvature of the throat of the cross section, and thus as a first approximation a mutual withdrawal of the two vertices of the Ω resting freely on the cylindrical centering surfaces formed on the periphery of the two flanges of the supporting structure. This mutual withdrawal is permitted by the absence of constraints and by the clearance left during assembly between the ring and shoulders of the peripheral surface of the supporting structure, so that the stress of thermal origin is not supported by the material of the casting ring but is discharged in the form of a free controlled translation of the support points in the axial direction; so safeguarding the material and its life.

Advantageously the two flanges forming the supporting structure are reinforced and independent, and are both fixed rigidly to the drive shaft of the casting wheel.

According to a specially advantageous embodiment of the invention, the flanges are connected together through connecting members arranged in the proximity of the casting wheel rotation axis and fixedly mounted to the casting wheel drive shaft and the cooling device is idly mounted on said connecting members, means being provided to hold the cooling device stationary as the flanges rotate.

A supporting structure constructed in this manner completely eliminates thermal stresses due to adjacent zones at different temperatures caused by the inteference between cooling jets and parts of the supporting structure, in that it does not require the connecting cross members between the flanges and leaves the zone occupied by the cooling jets completely free.

The arrangement of the connecting members close to the casting wheel axis permits direct coupling to the drive shaft, thereby both flanges act as driving members for the casting ring and the latter is relieved of its driving function for one of the flanges. Consequently, there are ensured both a more symmetrical drive action for the ring and the possibility of disengaging to some extent the ring itself from the flanges, i.e. of allowing for the distortion described above.

The connecting members, brought closer to the wheel axis, are now kept, together with the connection areas to the flanges, away from an area of high thermal stress such as the one next to the casting ring, where the connecting cross members are normally arranged, and are thus relieved of internal stresses likely to cause the premature failing and replacement thereof.

The use of two supporting flanges and the elimination of the cross members give further considerable advantages in addition to the absence on the inner surface of the ring of variously cooled zones, which are a cause of damaging thermal stresses. The distance of the spray nozzles from the inner surface of the casting ring, which in conventional constructions is determined by the existence of the cross members, can be varied at will in the proposed embodiment in order to determine an optimum level of heat transfer from the surface to the cooling fluid.

Within the space made available by the shifted location of the connecting cross members, means may be arranged to ensure a more uniform and effective distribution of the cooling fluid.

A further considerable advantage attained by said embodiment is that the uniformity of cooling so obtained enables the production rate to be increased as in practice the surface through which maximum heat transfer takes place has been increased, so obtaining metal of improved quality, in that the mechanical and electrical characteristics of the metal depend on the uniformity of the crystalline structure, this uniformity being favoured by the uniform cooling of the ring surfaces.

Advantageously, the cooling device is supported pivotally at its central portion and held stationary, as the flanges are rotated, by auxiliary means.

According to a most advantageous embodiment of this invention, such means comprises a ring gear affixed to the stationary structure of the machine and mounted coaxially to the outside of the drive shaft, a ring gear affixed to the cooling device within the flanges, and a pair of gear wheel mounted on a shaft penetrating pivotally one of the flanges, which engage respective ones of said ring gears. The gear ratio of one ring gear to its respective gear wheel is the same as that of the other ring gear and gear wheel.

This structural embodiment, which proves highly advantageous from the viewpoints of simplicity, reliability and manufacturing cost, brings about an absolutely fixed location for the cooling device and the differentially cooled areas of the casting ring. In fact, the rotation of the flanges causes one of the gear wheels to turn on that ring gear which is affixed to the machine stationary structure, and to revolve about said ring gear, these two combined motions, which are also followed by the other gear wheel about the other ring gear, cause the other ring gear to remain stationary with respect to the former since the gear ratios are the same.

Advantageously, the flange connecting members comprise a supporting element substantially configurated as a collar mounted coaxially to the drive shaft for rotation therewith, said substantially collar-like element being provided with peripherally arranged passageways for the coolant to flow from within the collar element to the cooling device. This embodiment allows the omission of the conventional fixed structure for supplying the cooling fluid, including a fixed axial duct within the drive shaft, and the provision of an axial passageway within the drive shaft, thereby the drive shaft itself acts as a duct line for the cooling fluid whih opens to the inside of the substantially collar-like element. Surrounding the collar element externally, there is advantageously provided an annular header which is stationary with respect to the collar element in order to collect the fluid from the passageways thereof and distribute it to the radially arranged ducts of the cooling device and to the external header or manifold carrying the spary nozzles.

The casting ring is constrained to be dragged in the direction of rotation of the casting wheel by a plurality of keys spaced apart along the periphery of the casting ring and flanges, the keys being disposed in such a manner as to allow the relative axial movement of the casting ring and flanges.

According to a further advantageous characteristic of the invention, the flanges comprise peripherally a plurality of through holes which connect to the outside the space between the flanges and casting ring for discharging the cooling fluid.

BRIEF DESCRIPTION OF THE DRAWINGS

Further characteristics and advantages of the invention will be more evident from the description of a preferred but not exclusive embodiment of a continuous casting machine illustrated by way of non-limiting example in the accompanying drawings in which.

DESCRIPTION OF THE PREFERRED EMBODIMENT

Figures 1, 2:
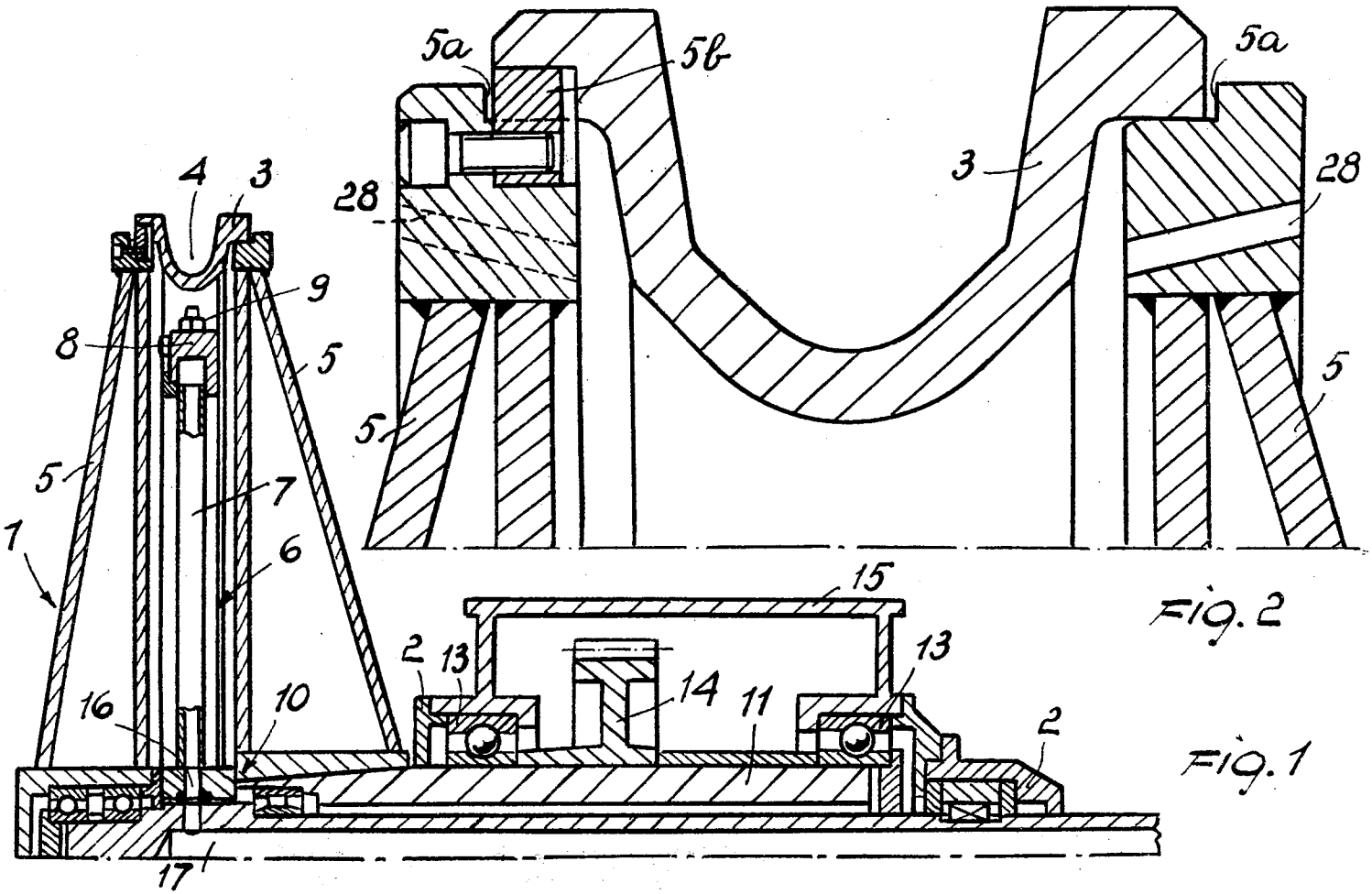
FIG. 1 is an axial sectional elevation of a casting wheel and ring according to the invention.
FIG. 2 is a sectional view to an enlarged scale of the casting ring of the wheel of FIG. 1 and the system for supporting it on the two flanges of the wheel.

The casting machine shown in the drawings comprises conventionally a casting wheel 1 pivotally supported by a stationary structure 2 and having a peripheral ring 3 which defines a casting groove 4. The latter is closed through a certain arc by a overlaying metal band (not shown) to form a molten metal receiving mold. The casting ring 3 is supported by a pair of support flanges 5, arranged coaxially and spaced apart one with respect to the other. To allow the free deformation of the casting ring under thermal expansion, as stated above, the casting ring is spaced from each of the facing lateral surfaces of the flanges 5 by an extent greater than maximum axial thermal expansion of the casting ring 3. An internal cooling device 6 is arranged between the support flanges 5 which is mounted stationary and does not rotate with the flanges 5. The numeral 7 indicates one of the radially arranged ducts leading the cooling fluid to the external annular header or manifold 8, whereon spray nozzles 9 for the coolant are arranged near the casting ring 3.

According to the invention the casting ring 1 has a cross section of substantially Ω form. The branches of said Ω, consisting of the outwardly extending peripheral edge flanges projecting parallel to the axis of the casting wheel, rest by their outer end on the portions cylindrical centering surfaces formed on the outer periphery of the support flanges 5 defining the support structure for the casting ring 3.

The flanges 5 are disposed facing each other and comprise a pair of shoulders **5*a* perpendicular to the axes of rotation and laterally bounding the cylindrical centering surfaces towards the outside. The distance between the shoulders 5***a* is such as to allow the ring 3 to expand in the axial direction, said ring being thus free to axially slide on said cylindrical centering surfaces because of the clearance between the outmost surfaces of the peripheral edge flange of the ring 3 and the shoulders 5*a*. The ring 3, simply resting on the outer peripheral surfaces of the support flanges 5, as best shown in FIG. 2, is also freely separable from these surfaces perpendicularly thereto under thermal expansion. The relative rotation of the ring 3 and flanges 5 is prevented by connection means comprising a plurality of keys 5b disposed spaced apart along the periphery of the ring 3 and flanges 5 and fixed to the flanges, for instance, by screws. These means therefore act as torque transmitting means from the driving flange to the casting ring. According to the embodiment shown in FIG. 1 only the right flange 5 is connected for rotation with the driving shaft 11 and the left flange 5 is idly mounted on the axle defining te duct 17. In this case the left flange is dragged in rotation by the right flange through the casting ring. According to the embodiment shown in FIGS. 3 and 4 the flanges 5 are both fixed independently to the drive shaft.

According to a most advantageous embodiment of the invention, the flanges 5 are interconnected by means of connecting members arranged in the proximity of the casting wheel axis and comprising, in the example shown, a substantially collar-like element 10, arranged coaxially to the drive shaft 11 for rotation therewith. In the embodiment shown, the element 10 has an annular projection 12 wherethrough it is mounted on the drive shaft 11 by means of key type connections. The drive shaft 11 is supported in the stationary structure 2 by bearings 13 and is driven through a pulley 14 protected by a shroud 15 and coupled to the driving means (not shown) of the machine.

The flanges 5 are both mounted directly to the collar element 10. However, the element 10 may be configurated as an extension of the drive shaft 11, and one of the flanges may be mounted directly to the drive shaft 11, while the other is mounted to said extension.

The collar element 10 is provided with a plurality of peripheral openings 16 for the cooling fluid to flow from the axial inner cavity 17 of the element itself to the cooling device 6, which is pivotally supported by the collar element 10 through bearings 18. The coolant reaches the axial cavity 17 through an axial passageway 19 provided in the drive shaft 11 and communicating to the cavity 17.

An inner annular header 20 is provided around the collar element 10 for the coolant from the peripheral through openings 16 provided in the rotating collar element 10. The header is stationary and integral to the central body 21 of the cooling device 6.

There is provided, according to the invention, means to hold the cooling device 6 stationary as the flanges rotate. In the exemplary embodiment shown, such means comprises a ring gear 22 affixed to the stationary structure 2 of the machine and arranged coaxially outside of the drive shaft 11, a ring gear 23 affixed to the central body 21 of the cooling device 6 within the flanges 5, and a pair of gear wheels 24,25 mounted on a shaft 26 penetrating privotally the flange 5 located closer to the drive shaft 11 and engaging respectively the ring gear 22 and ring gear 23. More particularly, the two gear wheels are located on either sides of one flange 5 and are protected by a shroud 27 extending to surround the ring gears 22,23.

The gear ratio of the ring gear 22 to the gear wheel 24 is the same as the ratio of the ring gear 23 to the gear wheel 25, thereby, as the flanges 5 rotate, both gear wheels rotate about the axis of the shaft 26 and revolve about the axis of the drive shaft 11; however, for one complete revolution the gear wheels make, with respect to their respective ring gears, the same number of turns about the axis of the shaft 26; since the ring gear 22 is stationary, the ring gear 23 will also remain stationary, and so will the whole cooling device 6. This occurs for any rotational speeds of the casting wheel. In the exemplary embodiment shown, the case has been considered in which the gear wheels 24 and 25 are identical, and so are the ring gears 22 and 23.

Figure 3:
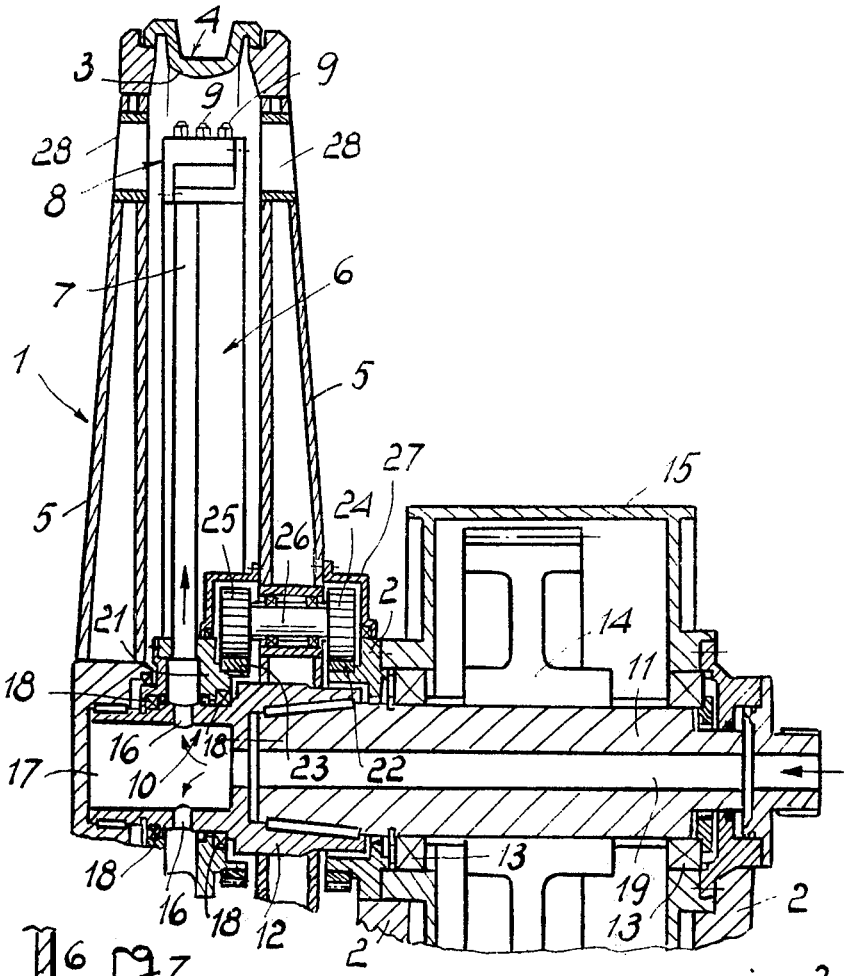
FIG.3 is an axial sectional view through the casting wheel and drive shaft of a casting machine according to a particular embodiment of the invention.
Figure 4:
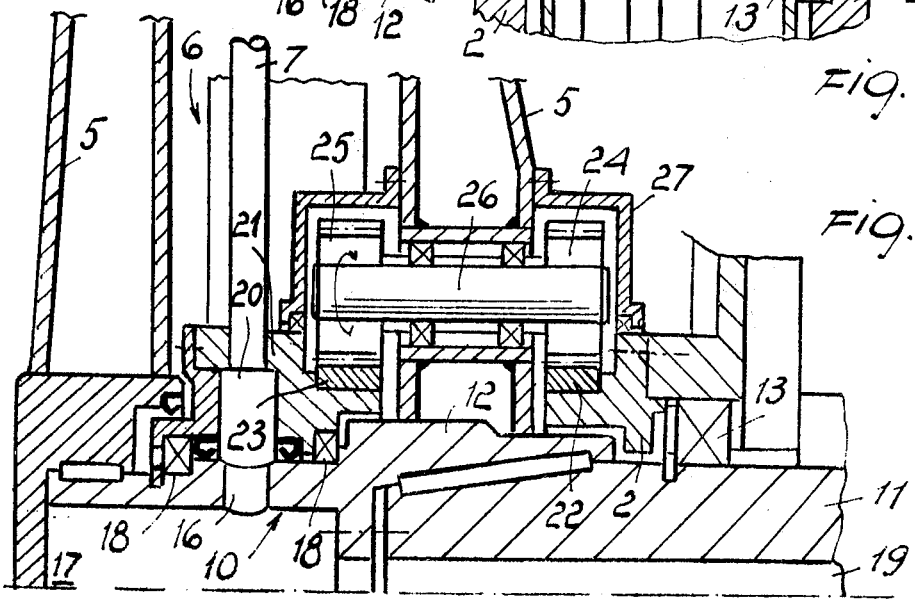
FIG. 4 is an axial sectional view, to an enlarged scale, of a detail of FIG. 3.

In FIGS. 3 and 4 there are also shown the various gaskets which ensure the sealing at zones where the coolant passes.

In FIG. 3, there is furthermore shown a casting ring 3 having a substantially Ω cross-sectional configuration, with bent over projections resting on the centering surfaces of the flanges 5. It should be noted, however, that it is alternatively possible to use the casting ring shown in FIG. 2 for the casting wheel illustrated in FIG. 3.

In order to drain the bottom portion of the wheel of the cooling fluid which accumulates thereat, through holes 23 (FIG. 3) are provided close to the outer edge of the flange 5. These holes may slope down outwards, as shown in FIG. 2.

It should be noted that the Ω-like cross-sectional configuration of the casting ring 1 enables through holes 28 to be provided in the proximity of the bottom part of the space defined by the ring and flanges, as shown in FIG. 2, such as to reduce the amount of hot coolant collecting at the bottom of the wheel, which amount is here considerably smaller than the amount encountered in wheels having casting rings with different cross sections, i.e. of M-like shape.

The fact that the described casting ring can expand and contract means that it can follow the expansions and contractions of the metal, so ensuring efficient contact with it and therefore efficient cooling, even during the stage in which the solidifying metal is shrinking.

The simple geometry of the ring cross section leads to a considerable saving both of material and of man hours required for its construction, a fact which is important from the point of view of the cost of the ring.

It should be noted that the location of the connecting members close to the axis of the casting wheel involves no irregularities in the delivery of cooling fluid to the ring from the spray nozzles since, although a certain interference is unavoidable by the parts adjacent the openings 16 in the element 10 with the fluid during rotation, this interference takes place at a point far away from the nozzles and is practically counteracted by the further presence of the stationary inner annular header 20, wherethrough the fluid is distributed to the radial ducts leading to the header 8 carrying the spray nozzles.

Furthermore, the embodiment described and illustrated offers no difficulties in the replacement of the casting ring, since it is possible to disassemble the front flange from the collar element 10 and then remove the ring for the replacement thereof.

The invention described hereinabove is susceptible to many variations and modifications, all of which fall within the scope of the invention. Thus, different means may be provided to hold the cooling device stationary as the flanges rotate. For example, when the wheel is of the spoke type, the spaces between the spokes may be utilized for the positioning therein and operation of resiliently acting members which are effective as detent means for the device 6, and which withdraw in succession under the action of the moving spokes to just resume their function as soon as each spoke passes by.

It is, moreover, possible to supply the cooling fluid through an axial hole provided in the front flange, rather than a central passageway provided in the drive shaft.

I claim:

1. A continuous casting machine of the type comprising a casting wheel rotatable around a substantially horizontal axis, a peripheral casting ring on said casting wheel, a band covering said casting ring through an arc of said casting wheel, a stationary cooling device arranged internally of said casting wheel for cooling said casting ring and a driving shaft for said casting wheel, wherein said casting wheel comprises two support flanges arranged in spaced relationship and having lateral surfaces facing each other and provided with outer peripheral support surfaces, at least one of said support flanges being connected for rotation with said driving shaft, and wherein said casting ring is spaced from each of said lateral surfaces of said support flanges by an extent greater than maximum axial thermal expansion of said casting ring and comprises outwardly extending peripheral edge flanges each having an outer end portion resting on a corresponding one of said outer peripheral support surfaces freely slideable thereon and freely separable perpendicularly therefrom under thermal expansion of said casting ring, the machine further comprising means between said at least one of said support flanges and the corresponding peripheral edge flange of said casting ring allowing free displacement of said corresponding peripheral edge flange in a direction substantially parallel to the axis of said casting wheel and in a direction substantially radially thereto under thermal expansion and causing torque transmission from said at least one of said support flanges to said casting ring.

2. A casting machine as claimed in claim 1, in which said peripheral casting ring has peripheral projecting edge flanges extending substantially parallel to the axis of said casting wheel, and said outer peripheral support surfaces each define a lateral shoulder facing the outmost face of the corresponding of said end portions of said peripheral edge flanges, said lateral shoulders being spaced from one another by an extent greater than the distance between said outmost faces of said end portions for allowing the casting ring to expand in axial direction.

3. A casting machine as claimed in claim 1, wherein said torque transmitting means comprise a plurality of keys arranged spaced apart along the periphery of said casting ring and said support flanges.

4. A casting machine according to claim 1, wherein said support flanges are connected to one another in the proximity of the axis of said casting wheel and are both connected for rotation with said driving shaft of said wheel, and wherein said cooling device is supported idly by said driving shaft within said flanges and comprises cooling fluid spraying nozzles arranged near said peripheral casting ring, said shaft including passages for supplying cooling fluid to said cooling device as said support flanges rotate.

5. A casting machine as claimed in claim 4, further comprising means for maintaining said cooling device stationary during rotation of said support flanges.

6. A casting machine according to claim 5, wherein said means for maintaining said cooling device stationary during rotation of said support flanges include a ring gear secured to the stationary structure of the machine and arranged coaxially to said shaft outside thereof, a ring gear secured to said cooling device within said support flanges, at least one shaft pivotally penetrating one of said support flanges and having a gear wheel at each end for engaging a respective one of said ring gears, the gear ratio of one ring gear to its respective gear wheel being the same as the ratio of the other ring gear to its respective gear wheel.

7. A casting machine according to claim 4, further comprising connecting members between said support flanges and said driving shaft, said connecting members comprising a supporting element substantially in the shape of a collar secured coaxially to said driving shaft for rotation therewith, said collar like supporting element having peripherally arranged through openings for the cooling fluid to flow from within said collar like supporting element to said cooling device.

8. A casting machine according to claim 7, wherein said driving shaft has an axially extending passageway for the cooling fluid, said passageway communicating with the inside of said collar like element.

9. A casting machine according to claim 7, wherein said cooling device comprises an annular header for the cooling fluid, said header being arranged around said collar like element and stationary with respect thereto and having passages for supplying the cooling fluid to said cooling device.

* * * * *